US009702071B2

(12) United States Patent
Harvill et al.

(10) Patent No.: US 9,702,071 B2
(45) Date of Patent: Jul. 11, 2017

(54) EMBROIDERY SYSTEM AND METHOD

(75) Inventors: Young Harvill, Half Moon Bay, CA (US); Rich Bean, Cupertino, CA (US); Robert Irven Beaver, III, San Francisco, CA (US); Chris Vanrensburg, Pacifica, CA (US)

(73) Assignee: Zazzle Inc., Redwood City, CA (US)

( * ) Notice: Subject to any disclaimer, the term of this patent is extended or adjusted under 35 U.S.C. 154(b) by 0 days.

(21) Appl. No.: 12/257,016

(22) Filed: Oct. 23, 2008

(65) Prior Publication Data

US 2010/0106283 A1 Apr. 29, 2010

(51) Int. Cl.
*D05C 5/02* (2006.01)
*D05C 5/04* (2006.01)

(52) U.S. Cl.
CPC ..... *D05C 5/04* (2013.01)

(58) Field of Classification Search
CPC ..... D05C 5/04; D05B 19/02; D05B 19/04; D05B 19/06; D05B 19/08; D05B 19/10; G06Q 30/0601; G06Q 30/0641; G06Q 30/0643
USPC .... 700/136–138; 112/102.5, 470.01, 475.09, 112/475.19
See application file for complete search history.

(56) References Cited

U.S. PATENT DOCUMENTS 5,343,401 A * 8/1994 Goldberg et al. ..... 700/138
5,422,819 A * 6/1995 Nakamura ..... G06T 5/20 700/135
5,850,222 A 12/1998 Cone
5,872,555 A * 2/1999 Kolar et al. ..... 345/594
6,012,402 A * 1/2000 Sekine ..... 112/102.5
6,012,890 A 1/2000 Celorio Garrido
6,173,211 B1 1/2001 Williams et al.
6,196,146 B1 * 3/2001 Goldberg et al. ..... 112/102.5
6,280,891 B2 8/2001 Daniel
6,310,627 B1 10/2001 Sakaguchi
6,321,670 B1 * 11/2001 Tomita et al. ..... 112/475.19
6,473,671 B1 10/2002 Yan
6,546,309 B1 4/2003 Gazzuolo
6,564,118 B1 5/2003 Swab
6,804,573 B2 10/2004 Goldman
6,842,532 B2 1/2005 Hu et al.
6,859,679 B1 2/2005 Smith
6,907,310 B2 6/2005 Gardner et al.
6,947,808 B2 9/2005 Goldman
6,968,075 B1 11/2005 Chang
(Continued)

FOREIGN PATENT DOCUMENTS

EP 1136899 9/2001
JP H02-104758 4/1990
(Continued)

OTHER PUBLICATIONS

Demarco (Zazzle and Pitney Bowes Team up to deliver custom stamps to consumers (2005), published online: http//www.zazzle.com/mk/welcome/pressreleases/pr071805_2.
(Continued)

*Primary Examiner* — Nathan Durham
(74) *Attorney, Agent, or Firm* — DLA Piper LLP (US)

(57) ABSTRACT

An embroidery system and method are provided in which a consumer can provide a design, such as images or text, have it converted into a digitized image and then used to generate customized embroidery that can be placed onto a product.

17 Claims, 15 Drawing Sheets

(56) References Cited

U.S. PATENT DOCUMENTS

| | | | | |
|---|---|---|---|---|
| 7,016,756 | B2 | 3/2006 | Goldman | |
| 7,016,757 | B2 | 3/2006 | Goldman | |
| 7,054,709 | B2 * | 5/2006 | Takeuchi | 700/138 |
| 7,216,092 | B1 | 5/2007 | Weber et al. | |
| 7,409,259 | B2 | 8/2008 | Reyes Moreno | |
| 7,479,956 | B2 | 1/2009 | Shaw-Weeks | |
| 8,069,091 | B1 * | 11/2011 | Callen et al. | 705/26.5 |
| 8,240,262 | B2 * | 8/2012 | Zeiger et al. | 112/470.01 |
| 2001/0026272 | A1 | 10/2001 | Feid et al. | |
| 2002/0007228 | A1 * | 1/2002 | Goldman | D05B 19/08 700/138 |
| 2002/0099524 | A1 | 7/2002 | Sell et al. | |
| 2003/0076318 | A1 | 4/2003 | Shaw-Weeks | |
| 2003/0120183 | A1 | 6/2003 | Simmons | |
| 2003/0168148 | A1 | 9/2003 | Gerber et al. | |
| 2003/0182402 | A1 * | 9/2003 | Goodman et al. | 709/220 |
| 2003/0184544 | A1 | 10/2003 | Prudent | |
| 2004/0078285 | A1 | 4/2004 | Buvoet | |
| 2004/0194344 | A1 | 10/2004 | Tadin | |
| 2004/0227752 | A1 | 11/2004 | McCartha et al. | |
| 2004/0236634 | A1 | 11/2004 | Ruuttu | |
| 2005/0131571 | A1 | 6/2005 | Costin | |
| 2005/0149223 | A1 * | 7/2005 | Takeuchi | 700/138 |
| 2005/0177453 | A1 | 8/2005 | Anton et al. | |
| 2005/0238251 | A1 | 10/2005 | Lunetta et al. | |
| 2006/0015207 | A1 | 1/2006 | Weiser et al. | |
| 2006/0020486 | A1 | 1/2006 | Kurzweil et al. | |
| 2006/0027154 | A1 * | 2/2006 | Naka et al. | 112/470.01 |
| 2007/0083383 | A1 | 4/2007 | Van Bael et al. | |
| 2007/0174132 | A1 | 7/2007 | Shemula | |
| 2007/0208633 | A1 | 9/2007 | Singh | |
| 2008/0006192 | A1 * | 1/2008 | Zeiger et al. | 112/102.5 |
| 2008/0079727 | A1 | 4/2008 | Goldman et al. | |
| 2009/0070666 | A1 | 3/2009 | Eilers et al. | |
| 2009/0122329 | A1 | 5/2009 | Hegemier et al. | |
| 2009/0182573 | A1 * | 7/2009 | Lidestri | 705/1 |
| 2009/0190858 | A1 | 7/2009 | Moody et al. | |
| 2009/0254207 | A1 | 10/2009 | Tiffany et al. | |
| 2010/0169185 | A1 | 7/2010 | Cottingham | |

FOREIGN PATENT DOCUMENTS

| | | |
|---|---|---|
| JP | 11076663 | 3/1999 |
| JP | 2001-314677 | 11/2001 |
| JP | 2002-133201 | 5/2002 |
| JP | 2005-118215 | 5/2005 |
| WO | 03/085186 | 10/2003 |

OTHER PUBLICATIONS

PCT/US09/061858 International Search Report dated Dec. 18, 2009.
PCT/US09/061858 Written Opinion dated Dec. 18, 2009.
PCT/US2009/061858 International Preliminary Report on Patentability mailed May 5, 2011.
PCT/US08/81215 International Search Report dated Jan. 5, 2009, 2 pages.
PCT/US08/81215 Written Opinion dated Jan. 5, 2009, 6 pages.
PCT/US09/54806 International Search Report dated Oct. 7, 2009, 3 pages.
PCT/US09/54806 Written Opinion dated Oct. 7, 2009, 3 pages.
PCT/US09/52154 International Search Report dated Sep. 23, 2009, 3 pages.
PCT/US09/52154 Written Opinion dated Sep. 23, 2009, 6 pages.
EP Application No. 08843251.3 Supplemental Search Report dated Nov. 23, 2010, 11 pages.
EP Application No. 09822776.2 Supplemental Search Report dated Mar. 2, 2012, 9 pages.
Ehara J et al: "Texture overlay onto deformable surface for virtual clothing" ACM International Conference Proceeding Series—Proceedings of the 2005 International Conference on Augmented Tele-Existence, ICAT '05 2005 Association for Computing Machinery USA, vol. 157, 2005 , pp. 172-179, XP002606672 DO!: DOI:10.1145/1152399.1152431 (8 pages).
Ehara J et al: "Texture overlay for virtual clothing based on PCA of silhouettes" Mixed and Augmented Reality, 2006. ISMAR 2006. IEEE/ACM International Symposium on, IEEE, PI, Oct. 1, 2006 (Oct. 1, 2006) , pp. 139-142, XP031014661 ISBN: 978-1-4244-0650-0 (4 pages).
Meseth "Towards Predictive Rendering in Virtual Reality" Ph.D. dissertation, Bonn University, published Oct. 2006 (369 pages).
Nelson, J "From Moon Shoes to Gel Gun—Sustaining Hart health", Columbian. Vancouver, Wash.: Oct. 11, 2007 (3 pages).
Scholz V et al: "Garment motion capture using color-coded patterns" Computer Graphics Forum Blackwell Publishers for Eurographics Assoc UK, vol. 24, No. 3, 2005 , pp. 439-439, XP002603022 ISSN: 0167-7055 (9 pages).
Japanese Patent Application No. 2011-533373, Office Action dated Nov. 8, 2012 (6 pages).
Canadian Patent Application No. 2,741,558, Office Action dated Dec. 5, 2012 (3 pages).
Japanese Decision of Final Rejection of JP 2011-533373 (English and Japanese); dated Jul. 31, 2013; (6 pgs.).
Canadian Examiner's Report of CA 2,741,558; dated Oct. 17, 2013; (2 pgs.).
Japanese Notification of Reason(s) for Rejection of JP 2013-249658 (English and Japanese); dated Dec. 25, 2014; (5 pgs.).
Japanese Notification of Reason(s) for Rejection of JP 2013-236779 (English and Japanese); dated Jan. 6, 2015; (10 pgs.).
Canadian Examiner's Report of CA 2,741,558; dated Jun. 12, 2015; (4 pgs.).
Extended European Search Report for EP 09822776.2; dated Mar. 2, 2012.
Heckbert, Paul S., *Fundamentals of texture mapping and image warping*, Master's Thesis under the direction of Carlo Sequin, Dept. of Electrical Engineering and Computer Science University of California, Berkeley. Jun. 17, 1989 (94 pgs.).
Wu et al., *Wavelength-multiplexed submicron holograms for disk-compatible data storage*, Optics Express, vol. 15, No. 26, Dec. 24, 2007, pp. 17798-17804 (7 pgs.).

* cited by examiner

POST IT FOR SALE

DESCRIBE AND ORGANIZE YOUR PRODUCT SO THAT OTHER PEOPLE CAN FIND IT

1. DESCRIBE IT

TITLE

UNTITLED EMBROIDERED T-SHIRT

SUBTITLE

PREVIEW

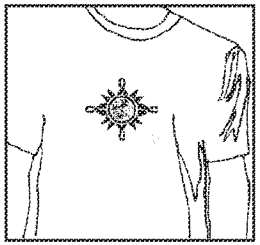

CUSTOMERS CAN BUY THIS DESIGN ON THE FOLLOWING APPAREL STYLES

◉ ALL APPAREL ○ ONLY LIGHT APPAREL ○ ONLY DARK APPAREL

CHANGING LIGHT AND DARK LIMITS HOW MANY STYLES ARE SHOWN TO CUSTOMER

DESCRIPTION (WHAT HTML IS ACCEPTABLE HERE?)

2. PUT IT IN THE MARKETPLACE

PRODUCT VISIBILITY

HIDE THIS PRODUCT

PUBLIC CATEGORY 1 * (SELECT)

(NONE SELECTED)

PUBLIC CATEGORY 2 (SELECT)

(NONE SELECTED)

GALLERY PRODUCT LINE * (CHANGE | CLEAR)

NEW PRODUCTS

SUITABLE AUDIENCE (WHAT IS THIS?)

◉ G ○ PG-13 ○ R

☑ ALLOW

3. YOUR P

NOW YOU GET
YOUR PRODUCT
WILL APPLY AC
OPTIONS THEY CHOOSE! LEARN MORE

ONLY DIFFERENCE HERE ARE THE BUTTONS. GO BACK RETURNS TO THE DESIGN TOOL, AND CONTINUE GOES ON TO THE ALMOST DONE PAGE.

ROYALTY PERCENTAGE: 12.0 % (ADVANCED CALCULATOR)

PRICE OF THIS PRODUCT: $16.35

ROYALTY YOU WILL MAKE: $1.96

☐ I AGREE TO ZAZZLE'S USER AGREEMENT

<< GO BACK | CONTINUE>>

FIG. 6A

EMBROIDERY SYSTEM AND METHOD

FIELD

The system relates to a system and method for generating customized embroidery on a product.

BACKGROUND

Producing an embroidered image on fabric from a custom design is still an art, rather than a science. The main reason for this is that the semantics and intent of the supplied custom design may be difficult to detect in an automated fashion. In addition, the task of translating an image into stitches of colored threads requires interpretation and artistic judgment during key parts of the process. The best quality embroidered designs are made by skilled artists. These designs retain the intent of the original source art and flow cleanly through the manufacturing process, with reduced thread breaks, color changes, and machine wear.

There are many commercial systems that provide a partial solution for automated production of embroidery from a digital image. Typically these systems start with a raster image and perform these steps:

1. Translate the Raster image into a vector image through well known methods.
2. Apply a stitch pattern and color to each region of the vector image.
3. Determine stitching for underlayment using stored data.
4. Determine stitch order based on minimizing connecting stitches.
5. Output a file containing instructions which embroidery software may edit.

Typically, editing is required to fix or optimize the automatically generated design. Thus, it is desirable to provide a system and method that allows a consumer to provide user content to generate customized embroidery on a product and it is to this end that the system and method are directed.

BRIEF DESCRIPTION OF THE DRAWINGS

FIGS. 6A-6C illustrate an example of user interfaces for posting a design or product in the embroidery marketplace that is part of the embroidery system.

DETAILED DESCRIPTION OF ONE OR MORE EMBODIMENTS

The system and method are particularly applicable to web-based client/server architecture system for generating a product with customized embroidery system and method implemented in software on a computer as described below and it is in this context that the system and method will be described. It will be appreciated, however, that the system and method can be used to customize any product on which it would be desirable to allow a consumer/user to place customized embroidery. In addition, the system and method can be implemented in software (shown in the illustrated implementation), hardware or a combination of hardware and software and may also be implemented on client/server system (shown in the illustrated implementation), a web server, a terminal, a peer to peer system and the like so that the system and method are not limited to the particular implementation of the system or method.

Figure 1A:
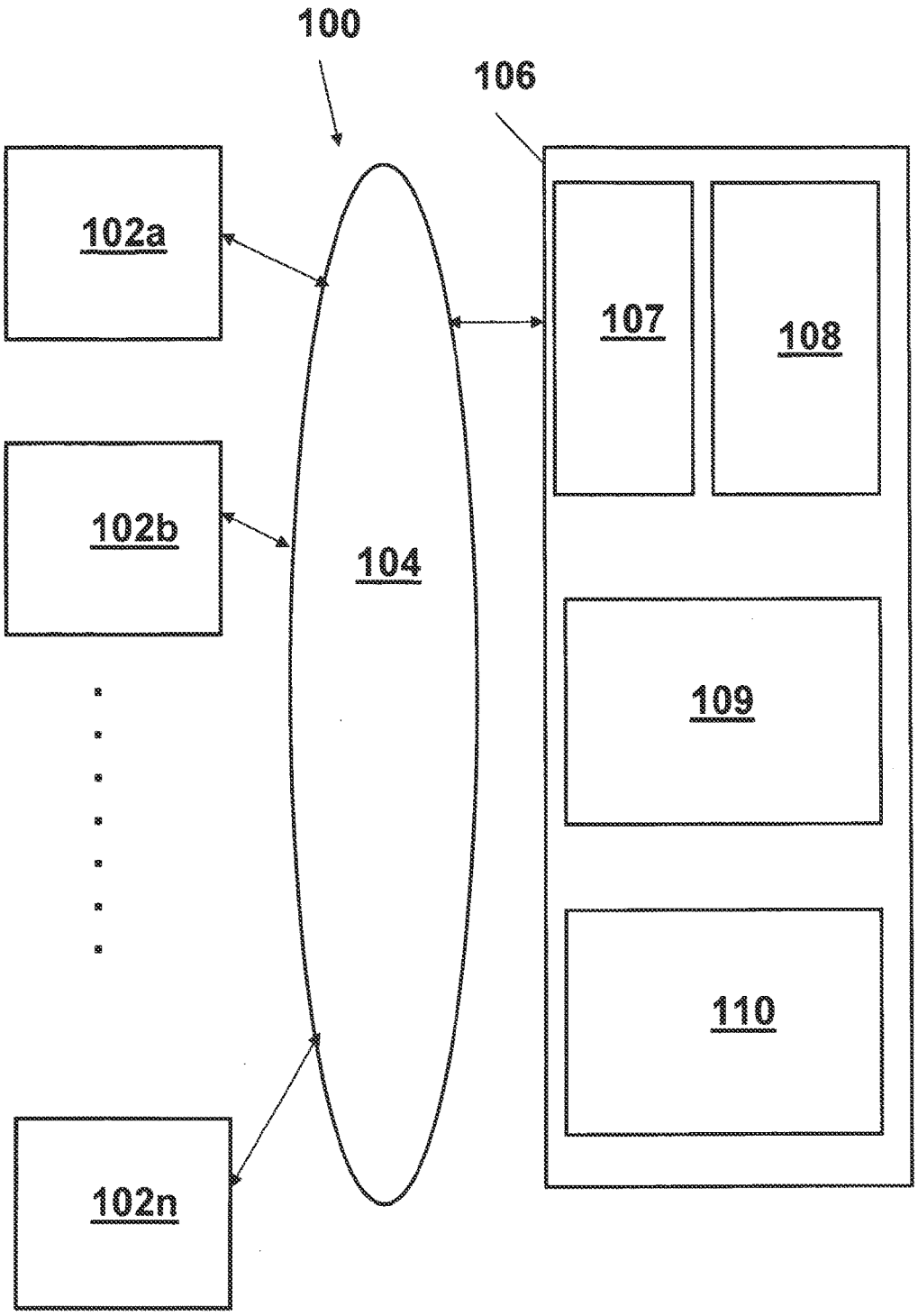
FIG. 1A illustrates an example of an embodiment of an embroidery system.

FIG. 1A illustrates an example of an implementation of an embroidery system 100. The system may include one or more consumer computing devices 102, such as 102*a*, 102*b*, . . . , 102*n*, wherein each computing device has at least one processing unit, memory, some persistent memory, some other memory, a display device and input/output devices and each may be a personal computer, mobile device, cellular device, wireless email device, converged device such as a Treo or Blackberry and the like that permit the consumer to interact with the consumer computing device as well as the system through an application, such as for example a well known browser application, being executed by the consumer computing device. Each consumer computing device may establish a connection with and communicate over a link 104 using a typical secure or unsecure protocol with am embroidery unit 106. The link 104 may be implemented using a computer network, a cellular network, a wired or wireless link and the like, In one embodiment, the link is the Internet. The embroidery unit 106 may be implemented in hardware, software or a combination of hardware and software. In one embodiment, the embroidery unit 106 may be one or more server computers that execute a plurality of lines of computer code to perform the functions and operations of the embroidery unit 106 as described below.

In one illustrative embodiment, the embroidery unit 106 may further comprise at least one web server 107 (implemented in hardware or software or a combination of the two) that establishes a connection with each consumer computer device, receives requests from each consumer computer device and communicates data and information (such as by using one or more web pages) and requests for consumer computer device information to each consumer computer device wherein the consumer computer device interacts with the web server using a known secure or unsecure protocol and a typical browser application. The at least one web server, for example, may serve a web page that allows the consumer to browse the available designs and then, using a digitized design (described below in more detail), place embroidery onto a particular product wherein the embroidery may be user content. The embroidery unit may further include a store 108, such as for example a database, that contains and stores the relevant information for the embroidery unit including the product information and images for the web pages, stitch files for a user, proxy bitmaps for the user supplied designs, user information for each user of the system, e-commerce related information for each user, etc. The embroidery unit may further comprise a embroidery customizer 109 (that may be implemented as a plurality of lines of computer code wherein the plurality of lines of computer code are executed by the processing unit(s) of the server computers to implement the embroidery unit that allows a consumer to submit a design, request digitization of the design (described below in more detail), review a proxy of the design before digitization, access a personalized library of stitch files, submit a design to a embroidery marketplace and request products with the embroidery as described below in more detail. The embroidery unit 106 may further comprise a well known ecommerce engine 110 that, once the consumer has finalized an embroidery design or selected an embroidery design, allows the consumer to customize a product with particular embroidery design and then purchase the customized product. In one implementation, the embroidery system may also be part of a larger web site/system such as, for example, as ww.zazzle.com. The system (referred to as the Embroidery System) takes a different approach to automation which is based on representing the entire set of social transactions (referred to as the Embroiderable Product Creation Flow) that need to occur for a customer to submit a design and purchase a high quality embroidered product.

Figure 1B:
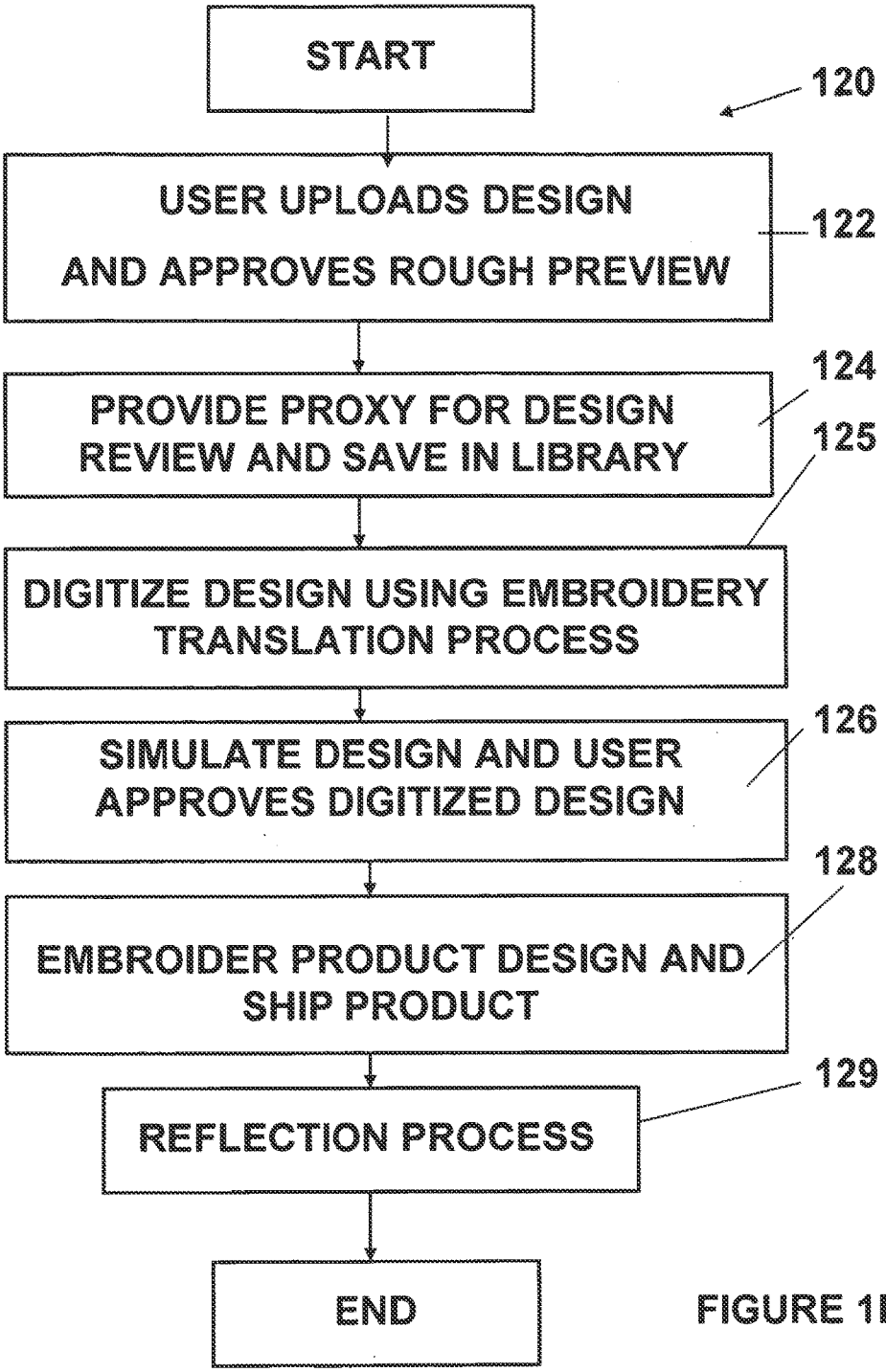
FIG. 1B illustrates an implementation of a method for automated embroidery.

FIG. 1B illustrates an implementation of an embroidery method 120 using the embroidery customizer 109 that is part of the embroidery system. The processes shown in FIG. 1B may be implemented in one embodiment as a plurality of lines of computer code (contained in one or more software modules/routines) executed by the one or more server computers. Each process described below may be thus implemented as a module or unit that performs the functions and operations described below. The various processes described below may also be implemented in hardware. The process begins when a user/customer uploads a design (122) from one of the one or more consumer computing devices 102 as shown in FIG. 1A to the embroidery unit 106 which is also shown in FIG. 1A. The design may be known as source image that is supplied to the embroidery design translation process 125 as described below that produces as it output, an embroidery design. The source image may have various formats, such as a rasterized format or a vector format. Once the source image has been uploaded, the consumer is able to view a visual approximation of the embroidery design (until the embroidery translation process is completed) known as the rough embroidery preview and approve it (122) using an embroidery preview component that is implemented in one embodiment as a plurality of lines of computer code executed on the embroidery unit 106.

Figure 1C:
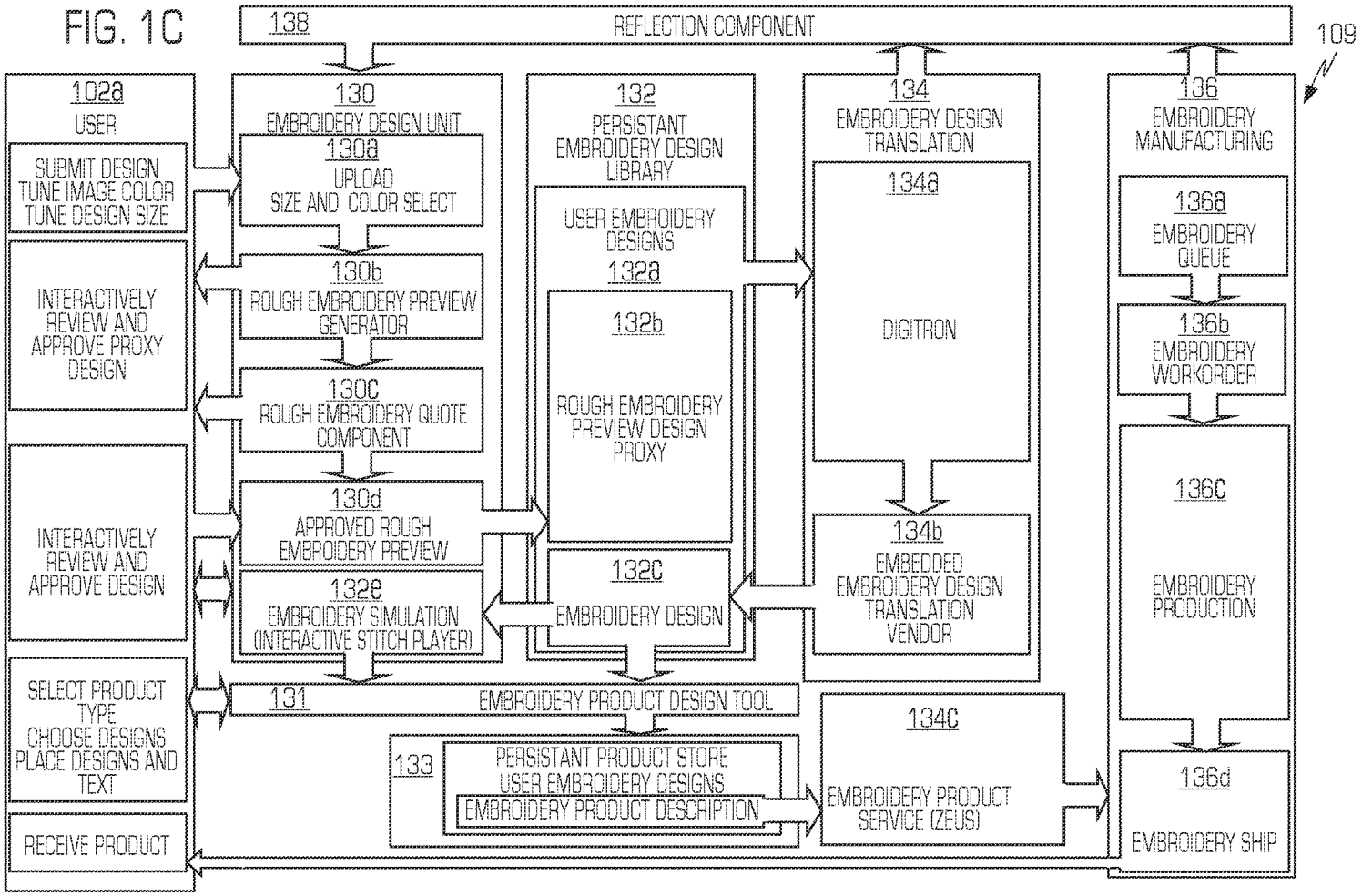
FIG. 1C illustrates an example of an embroidery system.

FIG. 1C illustrates further details of the embroidery customizer 109. The embroidery customizer 109 may receive input from and send data/information to the computing device 102 of the user using a UI portion 102*a* wherein the user can submit a design, tune an image color or tune a design shape, interactively review and approve a proxy design, interactively review and approve a design, select product type, choose designs, place designs and text and review the product with the embroidery. The embroidery customizer 109 may further comprise an embroidery design unit 130, an embroidery product design tool 131, a persistent embroidery design library 132, a persistent product store 133, an embroidery design translation component 134, an embroidery manufacturing component 136 and a reflection component 138 that is described below in more detail. In one implementation, each of these modules/units/components may be a plurality of line of computer code being executed by a processing unit of a computer system of the embroidery customizer 109. Alternatively, the units/components may be implemented in hardware.

The embroidery design unit 130 may further comprise a unit 130*a* to allow the user to upload, size and select color for an embroidery design, a rough embroidery preview generator 130*b* which is described below in more detail, a rough embroidery quote component 130*c* that is described below in more detail, an approved rough embroidery preview unit 130*d* that allows the user to preview the rough embroidery design and an embroidery simulation unit (interactive stitch player) 130*c* that is described below in more detail.

The persistent embroidery design library 132 may further comprise a user embroidery designs library 132*a*, a rough embroidery preview design proxy library 132*b* and an embroidery design library 132*c*, each of which is described below in more detail. Using the information in the persistent embroidery design library 132 and the embroidery design unit 130, the embroidery product design tool 131 generates the product with the embroidery design as described below in more detail. The persistent product store 133 may include user embroidery designs and embroidery product descriptions that can be used to generate the product as described below in more detail.

The embroidery design translation component 134 may further comprise the digitron component 134*a* (described below in more detail), an embedded embroidery design translation vendor 134*b* and a embroidery product service 134*c*, each of which is described in more detail below.

The embroidery manufacturing unit 136 may further comprise an embroidery queue 136*a*, an embroidery workorder unit 136*b*, an embroidery production unit 136*c* and an embroidery shipping unit 136*d*.

Rough Embroidery Preview (130*b*)

The rough embroidery preview depicts the colors that will be in the translated embroidery design and also indicates the amount of detail that the customer may expect in a finished embroiderable product design. The rough embroidery preview is a visual preview that is generated from the source image by the rough embroidery preview generator, and that acts as a rough guide as to how the source image may be translated to an embroidery design, and that does not engage the full embroidery design translation process. The rough embroidery preview acts as a proxy for an embroidery design in the user interface of the embroiderable product design tool, and other places in the user interface of the broader embroidery system where an embroidery design may need to be represented. In addition to acting as a visual proxy for an embroidery design, the rough embroidery preview can also be used to encapsulate guidelines—such as recommended colors—that should inform the embroidery design translation process.

Within the embroiderable product design tool, one or more rough embroidery previews can be used along with embroidery designs and embroidery text in the creation of an embroiderable product design. An embroiderable product design that contains rough embroidery previews cannot be materialized on an embroiderable product by the embroidery machine until all those rough embroidery previews have been replaced by embroidery designs that have been translated from the source images from which the rough embroidery previews were derived, through the embroidery design translation process. An embroiderable product design in this pending state may be purchased by the creator and may be published to an embroidery product design library or the embroidery product design marketplace, but may be unavailable to general users until the embroidery design translation process is complete.

The rough embroidery preview generator is software that produces a rough embroidery preview from a source image. The rough embroidery preview generator analyzes the source image and may employ algorithms to reduce the colors to the maximum allowed for an embroidery design, and to detect and remove a background that is not to be reflected in the translated embroidery design, thereby easing the creation of the embroidery design and minimizing costs during the embroidery design translation process.

The rough embroidery preview generator may also estimate the stitch count of the embroidery design—using a formula based on the area covered by the foreground, or other heuristics—in order to calculate a rough embroidery preview quote and an embroiderable product design price. It can be anticipated that steady innovations in the rough embroidery preview generator software will result in the rough embroidery previews it generates becoming increasingly effective—over time—as a proxy for a translated embroidery design, as well as the calculated rough embroidery preview quote and embroiderable product design price becoming increasingly accurate over time.

In one implementation, the rough embroidery preview component may use the following constraints in the embroidery manufacturing process to create the rough embroidery preview:

1. Embroidered product uses a fixed number of colors.
2. The smallest color area is limited by stitch size, limited color set, and color change mechanics.
3. The smallest detail in a embroidered product is limited.
   a. Detail is limited by the thread choice.
   b. Detail is limited by stitch length.
   c. Stitch length and thread choice are constrained by product substrate type.

In one implementation, the rough embroidery preview component performs the following processes to create a preview image:

1. Limit Image Detail
   a. Determine the ImageResolution based on the Thread size and Stitch size for a given ProductSubstrate.
   b. Apply an Edge-Preserving Low-Pass Filter to the Source Image to produce a Rough image.
2. Find the Product Embroidery Colors.
   a. Determine NumberOfColors to be used based on user choice and stored data.
   b. Determine the color resolution for the substrate and thread based on user choice and stored data.
   c. Determine a MaximumColorImageSize based on current image size and color resolution.
   d. Apply a color-preserving downsampling of the Source Image to produce a downsampled image smaller than MaximumColorImageSize (described below in more detail).
   e. Apply color clustering to the downsampled image to find a set of colors within a larger set of available thread colors.
3. Limit Image Colors
   a. For each pixel in Rough image, find the closest color match in the Product Embroidery Colors, and set the pixel to that color.
4. Embed Product Information.
   a. Store the Product Embroidery Colors in the Rough image.
   b. Store the Substrate choice in the Rough Image.
   c. Store the Color Resolution in the Rough Image.
   d. Store the Image resolution in the Rough Image.

In one implementation, the rough embroidery preview component performs Color-Preserving Downsampling by the following processes:

1. Accept an Input Image and Maximum Size for downsampling.
2. Perform the following steps while the Input Image is Greater than Maximum Size.
   a. Create a Destination Image that is sized to (OriginalSize/2)+1 of each image dimension of the Input Image size.
   b. Set the Destination Row to the First Row of the Destination Image.
   c. Starting with the second row and for every other row until the end of the rows in the Input Image:
      i. Set the Destination Pixel to the Current Destination Row.
      ii. Starting with the second column, and for every other column until the end of columns in the Input Image:
         1. Find the Pixel at the Input Image Row and Column, and call it InputPixel.
         2. For each Pixel adjacent to the InputPixel:
            a. Find the Adjacent Pixel that is closest to InputPixel in color space.
         3. Set the Destination Pixel to the Found Closest Adjacent Pixel.
         4. Increment the Destination Pixel to the next column.
      iii. Increment the Destination Row to the next Row in the Destination Image.
   d. Set the Input Image as the Destination Image.
3. Return the downsampled Input Image.

Rough Embroidery Quote Component (130*c*)

Returning to FIG. 1B, the embroidery system can provide an interactive cost for the rough embroidery preview (using a rough embroidery quote component that is implemented in one embodiment as a plurality of lines of computer code executing on the embroidery unit 106), based on user choice and source image statistics, and the cost is referred to as the rough embroidery preview quote. The rough embroidery preview quote component uses information provided by the rough embroidery preview component, along with its own analysis of the resulting rough embroidery preview to determine a price to quote (known as the embroidery design translation price) for the embroidery design translation process for the given source image as described below in more detail. The embroidery design translation price is based on factors that determine the time it would take a skilled artisan (the embroidery design translator) to interpret the source image as an embroidery design. The embroidery design translation price is often based on the total number of embroidery stitches in the resulting embroidery design (called the stitch count) which is a measure that is easily verified and correlates well enough to the labor involved in the embroidery design translation process that it has become a common practice to price this way. Another measure commonly used is the embroidery design area (i.e., number of square inches covered by threads in the embroidery design) and the embroidery design area has been found to correlate roughly to the Stitch Count of the resulting embroidery design so the two measures serve similarly to price the labor to translate the source image into the embroidery design.

The rough embroidery preview quote component determines the price of the embroidery design translation process using the above-mentioned stitch count metric. The actual conversion from a Stitch Count to a price is determined by business factors, and can either be a linear relationship (e.g., $10 per 1000 stitches in the embroidery design), a tiered relationship (e.g., $10 up to 1000 stitches, $20 for 1001 to 2000 stitches, $40 for 2001 to 3000, and so forth), or some other formula.

The stitch count in this component is an estimate, since the rough embroidery preview quote is generated before the source image has been translated to an embroidery design.

The rough embroidery preview quote component may compute the stitch count estimate using an estimate of the embroidery design area since the source image will be translated to an embroidery design at specific physical dimensions. The specific physical dimensions are communicated to the embroidery design translator (described below) and the resulting embroidery design must occupy those exact physical dimensions (e.g., 3 inches by 4 inches).

The source image may have background and foreground components. The background is the part of the source image that typically surrounds the part of the source image that will actually be translated into the embroidery design. The embroidery design translator will apply judgment to decide which part of the source image is intended to be part of the embroidery design (the foreground), and which part is not (the background). Often, this is obvious, such as a cartoon character appearing on a solid white background field. The rough embroidery preview quote component may uses image processing techniques to determine automatically which part of the source image is the foreground. These techniques are typically performed on the rough embroidery preview rather than the source image itself because the rough embroidery preview is more limited in its color set and is a simpler image to analyze for foreground and background separation. An example of a technique for determining the foreground and background components is to sample pixels around the border of the source image and then use the color of the majority of those pixels to determine a background color and any pixels in the rough embroidery preview that are not the same color as the background color are then determined to be foreground. However, it is also possible to use more sophisticated techniques, such as seed fill algorithms, that take into account areas that are inside the foreground part of the image, but happen to have the same color as the background color. Therefore, the rough embroidery preview Quote Component is not limited to using this method of separating foreground pixels from background pixels.

Once the rough embroidery preview quote component has determined the foreground pixels in the rough embroidery preview and has the exact expected physical dimensions of the desired embroidery design, the rough embroidery preview quote component can compute the area covered by the foreground pixels of the rough embroidery preview at the resolution defined by the desired physical dimensions for the entire rough embroidery preview and this area will be the embroidery design area assuming that the foreground pixels were accurately determined.

The rough embroidery preview quote component then computes a stitch count estimate with an input that is the estimated embroidery design area and whose output is a stitch count estimate. The stitch count estimate may be a simple linear equation s=a*factor+base, where "s" is the stitch count estimate, "a" is the estimated embroidery design area in square inches, "factor" is a multiplicative factor to relate area to stitch count, and "base" is a minimum stitch count estimate value. In practice, this estimate has proven to be quite well correlated with the actual stitch count of the resulting embroidery designs, to the degree that a profitable embroidery translation process can be based on the prices quoted by this process.

Figure 3:
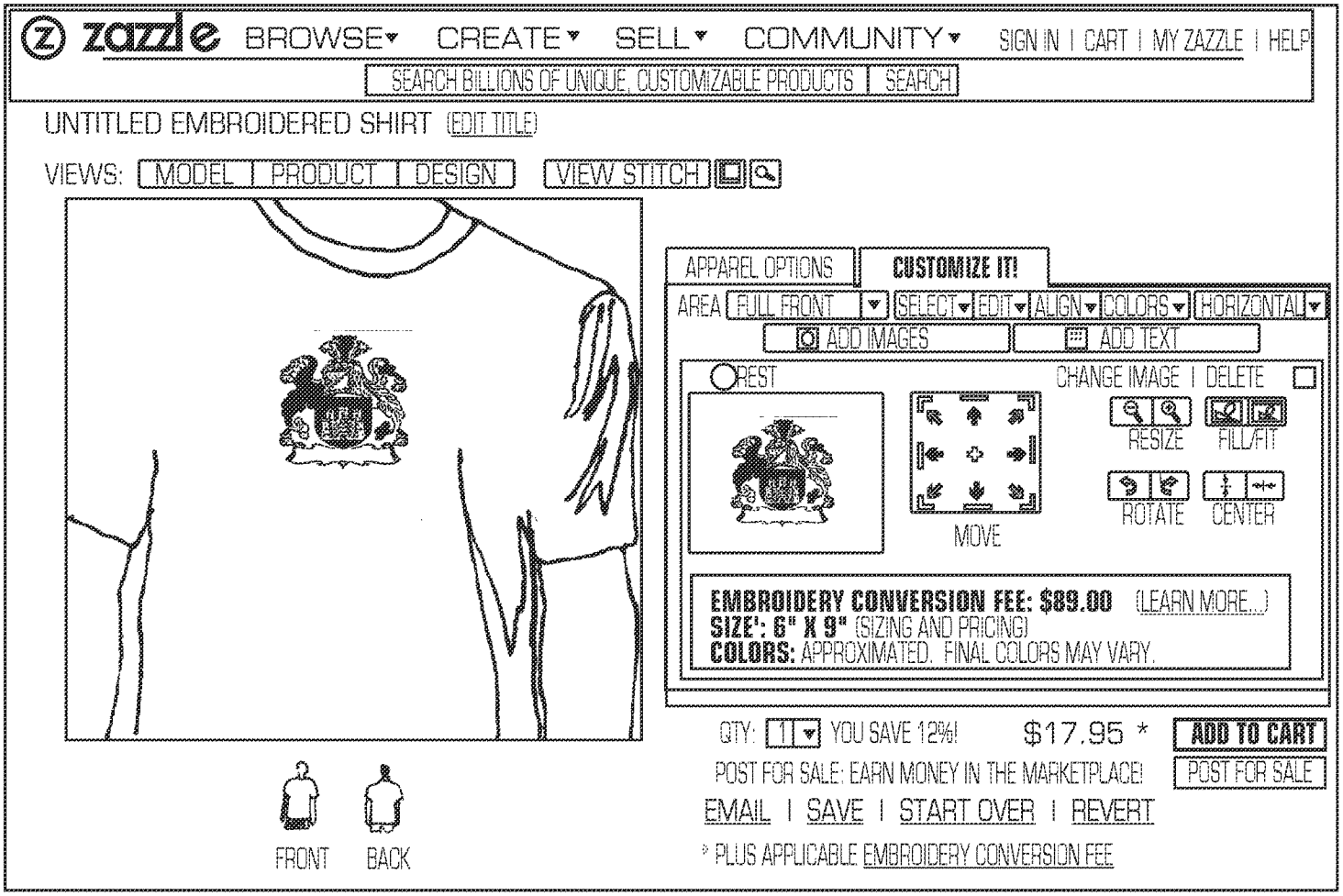
FIG. 3 illustrates an example of a user interface with a digitization price.

Furthermore, there can be other factors besides pure foreground area to estimate stitch count. For example, stitches may overlap, and an estimate of local image complexity which could estimate the amount of area covered more than once by stitches would improve this estimate for complex images. We allow that the rough embroidery preview quote component might use these other factors to provide more accurate estimated stitch counts and hence produce rough embroidery preview quotes (an example of which is shown in FIG. 3) that are less likely to differ from the actual cost of the embroidery design translation process.

Proxy (132*b*)

Returning to FIG. 1B, it is possible for the customer to immediately accept the rough embroidery preview or to first tune color and size settings to achieve the desired image detail before accepting the rough embroidery preview. Once the rough embroidery preview is accepted it becomes the proxy for the translated embroidery design (124) and in this state is referred to as an accepted rough embroidery preview. This proxy may be used in all instances that a translated embroidery design may be used. The system generated rough embroidery preview quote becomes the price of the translated embroidery design. The proxy (accepted rough embroidery preview) is saved to a collection of customer art (referred to as an embroidery design library) (124), and may be placed interactively on different embroiderable products, combined with embroidery text, and embroidery designs. In addition, the proxy may also be edited for color and orientation in the context of an embroiderable product design.

The embroidery design library is a collection of embroidery designs, which may have been uploaded, or which may have been generated from source images uploaded and then translated to embroidery designs through the embroidery design translation process. Multiple embroidery designs contained inside an embroidery design library may have been translated from the same source image, in accordance with different manufacturing parameters for each, such as physical size, stitch count, orientation, fabric substrate, and others. In the event that multiple embroidery designs are translated from the same source image, this relationship may be indicated in the user interface. The embroidery design library may also contain accepted rough embroidery previews that are pending translation to embroidery designs through the embroidery design translation process.

The embroidery system can support multiple embroidery design library instances, each instance of which is managed by an embroidery design library owner. Embroidery designs contained in the embroidery design library can be accessed and utilized from within the embroiderable product design tool during the process of creating embroiderable product designs. Additionally, embroidery designs from the embroidery design library may be made available for use by those other than the embroidery design library owner, by being listed in an embroidery design marketplace.

The embroidery design library owner is one or more persons provided management access to an embroidery design library. Management of embroidery designs within the embroidery design library may involve the assignment and modification of titles, tags, descriptions, and other meta data describing embroidery designs or governing aspects of their use within other components of the embroidery system. The embroidery design library owner can control the contents of an embroidery design library and the terms under which individual embroidery designs contained within it may be utilized in the embroidery design marketplace described below.

Embroidery Design Translation Component and Process (125 and 134)

Figure 1D:
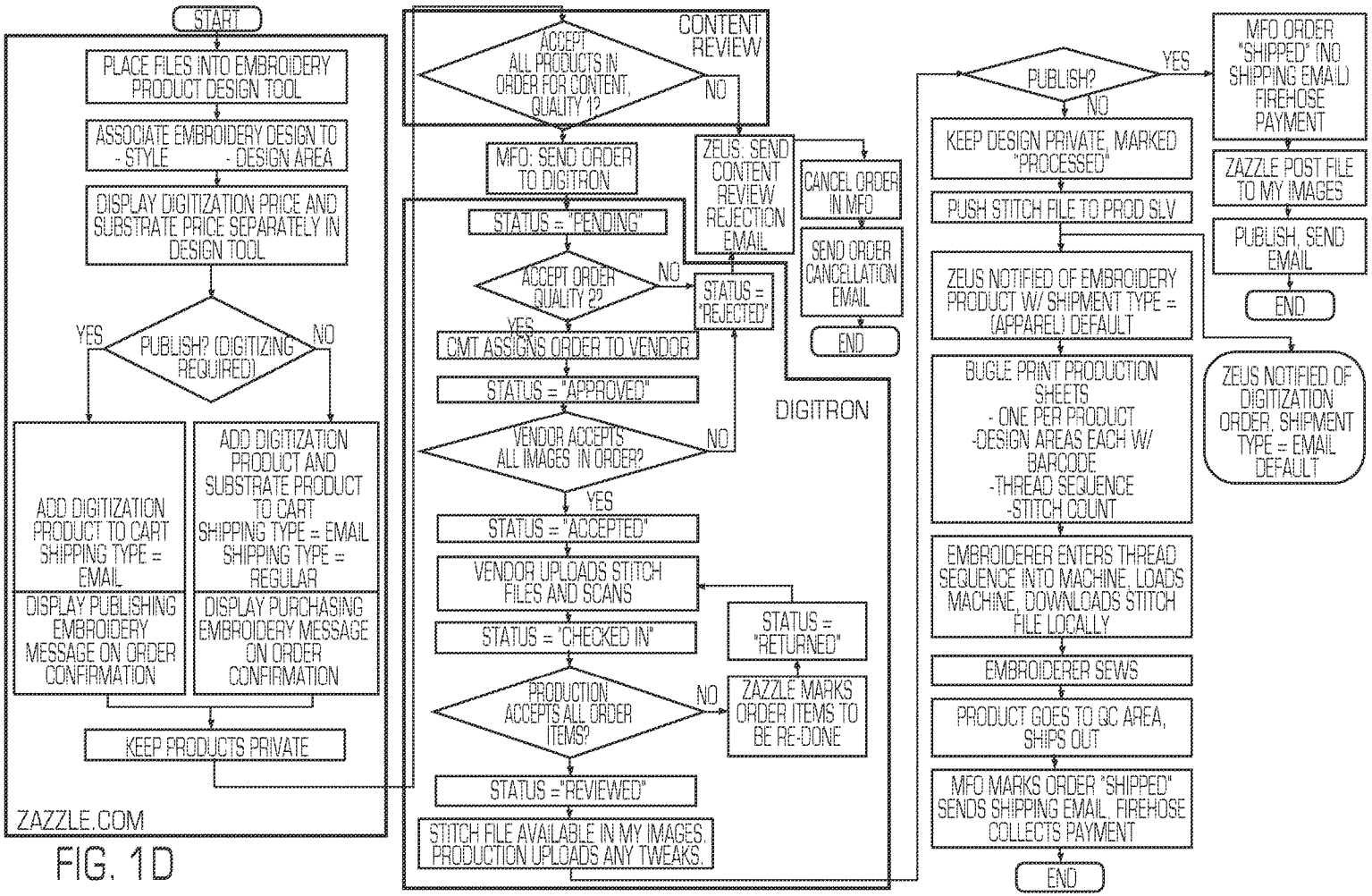
FIG. 1D illustrates more details of the digitron process that is part of the embroidery system.

The embroidery system embeds an agreement with skilled artisans (an embroidery design translation vendor) and will engage them to translate the source image, using instructions contained in the accepted rough embroidery preview, into an embroidery design. This process is referred to as the embroidery design translation process and includes the Digitron process as shown in FIG. 1D. This component accepts as an input accepted rough embroidery previews and produces as an output embroidery designs. The embroidery design translation process component serves to connect the embroidery system to external services and coordinate aspects of this interchange.

The embroidery design translation vendor is an external vendor of embroidery design translation services that may employ skilled artisans and proprietary technologies in the translation of accepted rough embroidery previews to embroidery designs, utilizing color choice cues and other guidelines captured within those accepted rough embroidery previews.

A centerpiece of the embroidery design translation process component is the embroidery design translation job manager which facilitates management and coordination of multiple embroidery design translation jobs and serves as an interchange between the embroidery system host and multiple embroidery design translation vendors. As such, users of the embroidery design translation job manager will include the embroidery system host and embroidery design translation vendors.

The embroidery design translation job manager will have access to a data store, in which data describing multiple embroidery design translation jobs and multiple embroidery design translation vendors will reside. The embroidery design translation job manager may implement administration tools to allow the embroidery system host to set up and manage accounts held by embroidery design translation vendors and may also allow such vendors to configure preferences for their participation within the process.

The embroidery design translation job manager may implement job management tools to allow the embroidery system host to review and assign embroidery design translation jobs to embroidery design translation vendors, to allow such vendors to accept and check out assets for jobs assigned to them, to allow vendors to check in assets for completed jobs, and to allow the embroidery system host to review assets for and approve completed jobs.

The embroidery design translation job manager may implement a system for producing reports, such as general health reports assessing the status of jobs in the system, as well as performance reports to assist in diagnosing inefficiencies within the system and to aid in evaluating embroidery design translation vendors. The reporting system may also utilize data contained within the data store to corroborate charges contained within invoices supplied by embroidery design translation vendors, testing for such things as discrepancies between estimated stitch count for embroidery designs and stitch counts used by embroidery design translation vendors in formulating charges for embroidery design translation jobs.

The embroidery design translation job manager may implement a triage system to facilitate resolving problems that require corrective action by the embroidery system host, such problems including jobs that have been rejected by embroidery design translation vendors, and jobs that have failed to be assigned to embroidery design translation vendors, amongst others.

A typical flow within the embroidery design translation process component is described, involving the following steps:

1. An embroiderable product design containing one or more rough embroidery previews is ordered or is published to the embroiderable product design marketplace.

2. The embroidery system enters embroidery design translation jobs, in a pending status, into the embroidery design translation job manager for each of the rough embroidery previews contained inside the embroiderable product design.

3. The pending embroidery design translation jobs are reviewed by a content review team to ensure that the content complies with limitations imposed by the embroidery system host's appropriate use guidelines and relevant terms of service agreements governing the service. Reviewing a job before assigning it to an embroidery design translation vendor avoids a loss that would be incurred if the job were to be rejected later, after the vendor had already provided their services.

4. Upon passing content review, the pending embroidery design translation jobs are assigned to appropriate embroidery design translation vendors, at the discretion of an operator of the embroidery design translation job manager, and possibly guided by heuristics that take into account vendor availability, vendor load management, specific vendor expertise and specializations, and cost competitiveness factors, amongst others.

5. Embroidery design translation vendors may be notified by the embroidery design translation job manager that the new jobs have been assigned to them.

6. Through a user interface of the embroidery design translation job manager, an embroidery design translation vendor may accept the jobs that have been assigned to them and may check out the rough embroidery previews necessary for them to complete the jobs, or they may decline jobs, which jobs will then be entered into the triage system for possible re-assignment or other corrective action.

7. Upon completion of jobs accepted by an embroidery design translation vendor, the vendor will check in the translated embroidery designs and update status for the jobs through a user interface of the embroidery design translation job manager.

8. An operator of the embroidery design translation job manager may be notified of the completed jobs in order to generally monitor the process, or may be required to explicitly approve jobs before continuation of the flow, with rejected completed jobs being entered into the triage system.

9. The embroidery system may notify the creator of the embroiderable product design and provide them the opportunity to approve or reject the results of the embroidery design translation process, with rejected jobs being entered into the triage system.

10. Upon acceptance of embroidery designs generated by embroidery design translation vendors, such embroidery designs are entered into an embroidery design library for future use, and any source image references in the embroiderable product design are replaced with references to the embroidery designs translated from those source images.

11. Upon updating of the embroiderable product design to reference the translated embroidery designs, the embroiderable product design may be entered into an embroiderable product design library or may be submitted to the manufacturing flow, dependent upon how the embroidery design translation flow was initiated.

Returning to FIG. 1B, once the translation process is complete and an embroidery design has been produced, the embroidery system replaces the accepted rough embroidery preview with the embroidery design, and notifies the customer of this development. The notification contains an interactive simulation of the embroidery design being manufactured (126).

Embroidery Simulation/Interactive Stitch Player (130*e*)

The simulation is referred to as the embroidery simulation and it shows the translated embroidery design using the embroidered textures and colors placed by the artisan. The simulation also emulates the tolerances of the embroidery machine. The embroidery simulation is an animated presentation—much like a movie—that demonstrates to the user how the embroidery machine might execute the stitch instructions implicit in an embroidery design, embroidery text, or different embroidery area designs contained inside an embroiderable product design.

The embroidery simulation may simulate traits of a materialized embroiderable product design, including variations in placement of stitches, thread response (such as twisting), and the way that light may interact with the stitches under various configurable lighting conditions. The embroidery simulation may also realistically depict the fabric substrate upon which embroidery is being stitched, including qualities such as the wale or napping of coarsely textured fabrics.

Figure 7:
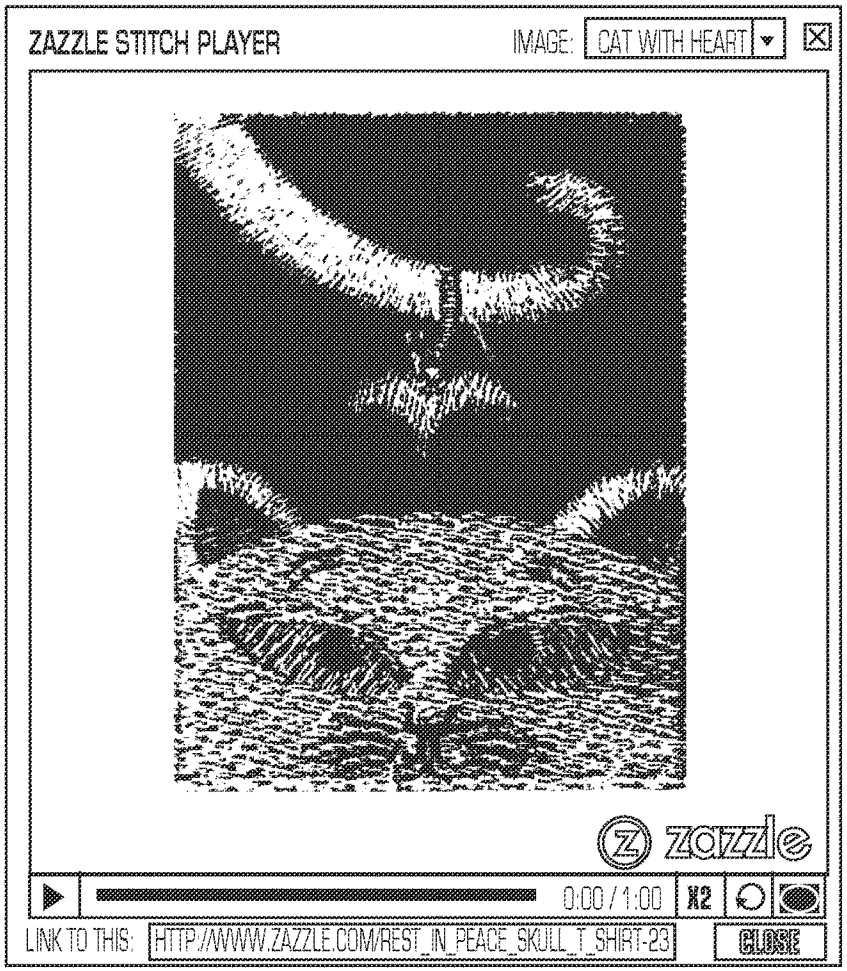
FIG. 7 illustrates an example of a user interface of a stitch player.

FIG. 7 illustrates an example of the user interface of the interactive stitch player. The embroidery simulation can act as a proxy for a materialized embroiderable product design, providing a life-like simulation, by means of which the user can review an embroidery design (that has been derived from a source image through the embroidery design translation process) before agreeing to purchase an embroiderable product design utilizing it. The embroidery simulation can also act as a vehicle for promoting and highlighting the value, quality, and intricacy of an embroiderable product design, in order to elevate a consumer's confidence in such a product, and providing the consumer a means of reviewing the embroiderable product design in more detail before purchase.

In one implementation, the embroidery simulation component simulates the way the design will be stitched onto fabric, using the following metrics:

1. The Embroidery Machine's error tolerance in placing a stitch.
   a. Repeatability.
   b. Distribution of error in stitch placement.
2. The physical appearance of the thread.
   a. Thread Thickness.
   b. Internal reflectance of color within the thread.
   c. Effects of thread surface transparency on specular reflection.
   d. Number of filaments in a thread.
   e. The softening effect of fibrils within each filament.
   f. The distribution of filament twist frequency in stitches.
3. The stitch order.

In one implementation, the component performs the following processes to provide a simulation of how the Embroidery Design will be stitched on a Product Substrate:

1. Initialization
   a. Render Normal Maps
      i. Distribution of Stitch Lengths
      ii. Distribution of Stitch Filament Twists
   b. Load ZTR file
      i. For each Atom within the file
         1. determine type of encryption
         2. load thread colors with encryption type
         3. load stitch opcodes with encryption type
   c. Load Image references
      i. Background Images
      ii. Rough Embroidery Images as Proxy
2. Running
   a. Render Stitches
      i. Choose Normal Map for Stitch based on
         1. Length Distribution
         2. Twist Distribution
      ii. Render Stitch Normal Map on Substrate using these steps:
         1. Apply ambient light to normal map filtered by thread color
         2. Apply diffuse light to normal map using internal reflectance function
         3. Apply specular light to normal map using surface transparency function
      iii. Govern stitch speed by Stitch Rate.
3. Response To User Action
   a. Update these User displays
      i. Percent complete
      ii. Stitch time
      iii. Play state.
   b. Respond to these User Actions
      i. Change in Stitch Rate
      ii. Change in Play State (Pause or Play)
      iii. Stop or End Simulation Embroidery Product Design Tool/Component (131)

Returning to FIG. 1B, the customer may reject the embroidery design if it does not meet expectations. If the embroidery design is rejected, it is removed from the customer's embroidery design library. The embroidery system then exits this set of steps.

The embroiderable product design tool is an interactive interface that permits the user to create custom embroiderable product designs for multiple types of embroiderable products. The tool provides a mechanism for adding various supported types of content to the embroiderable product design being edited. For example, users may add a source image or embroidery design, either uploaded to the embroidery system from their computing device, or accessed by means of a media browser from an asset library that is hosted by the embroidery system. Rough embroidery previews or accepted rough embroidery previews that are awaiting translation to embroidery designs by the embroidery design translation process may also be added in this manner.

Figure 2:
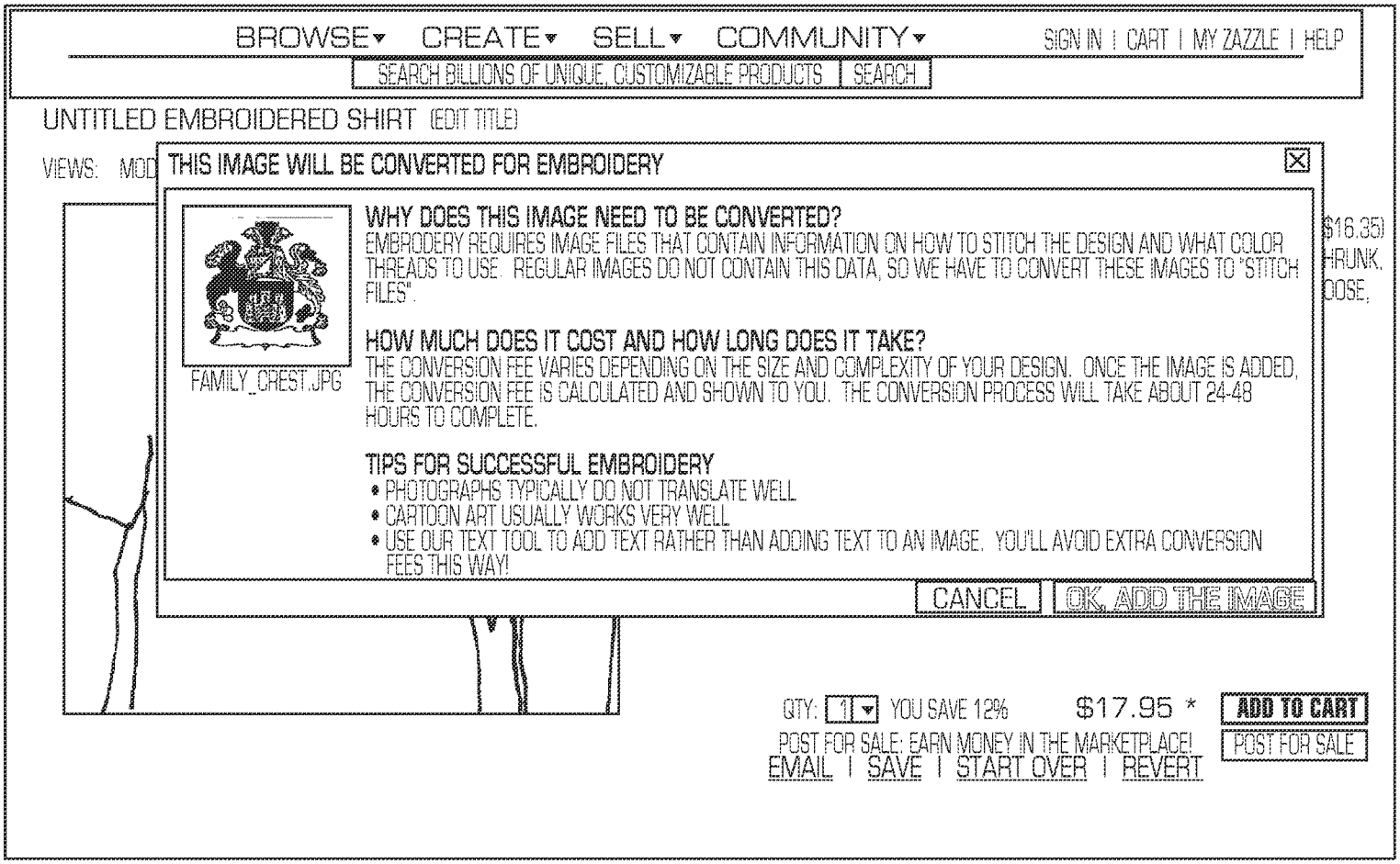
FIG. 2 illustrates an example of a user interface explaining the digitizing of a source image.

Upon adding new source images to an embroiderable product design, facilities within the user interface may prompt and inform the user of translation that will need to occur in order for such source images to be producable as embroidery on an embroiderable product as shown in FIG. 2. Due to tolerances of the embroidery design translation process, source images placed upon an embroiderable area may be scalable larger than would otherwise be permissable for printing processes.

Figure 4A:
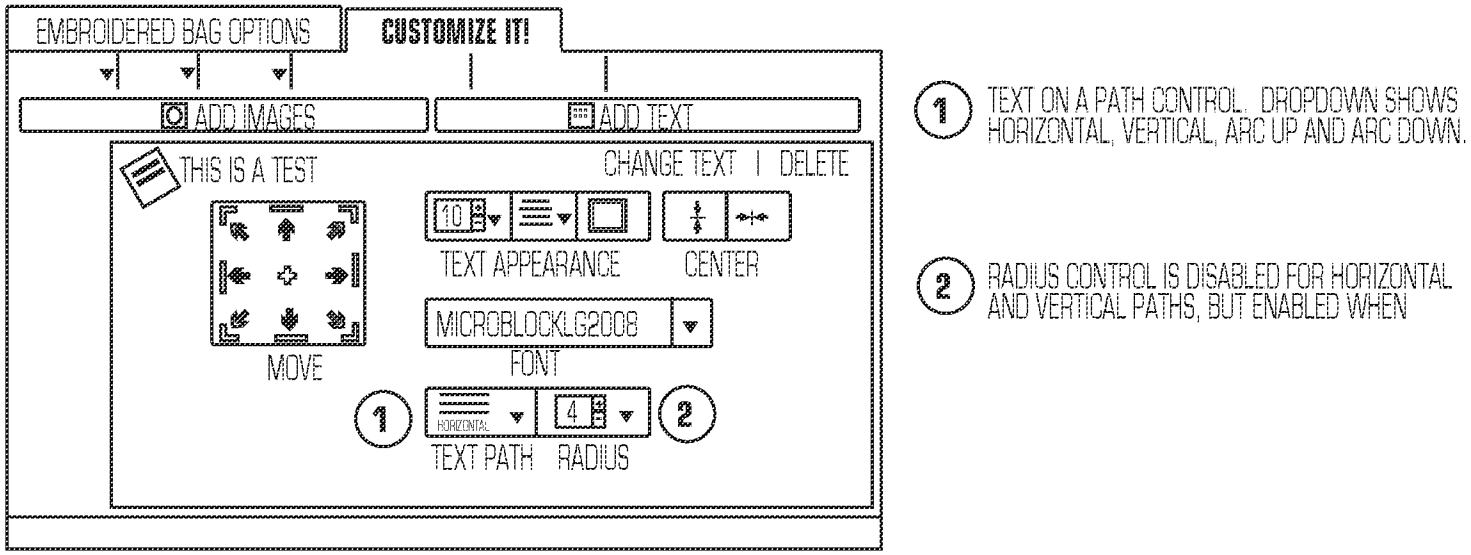
FIGS. 4A and 4B illustrate an example of a user interface for embroidery text.
Figure 4B:
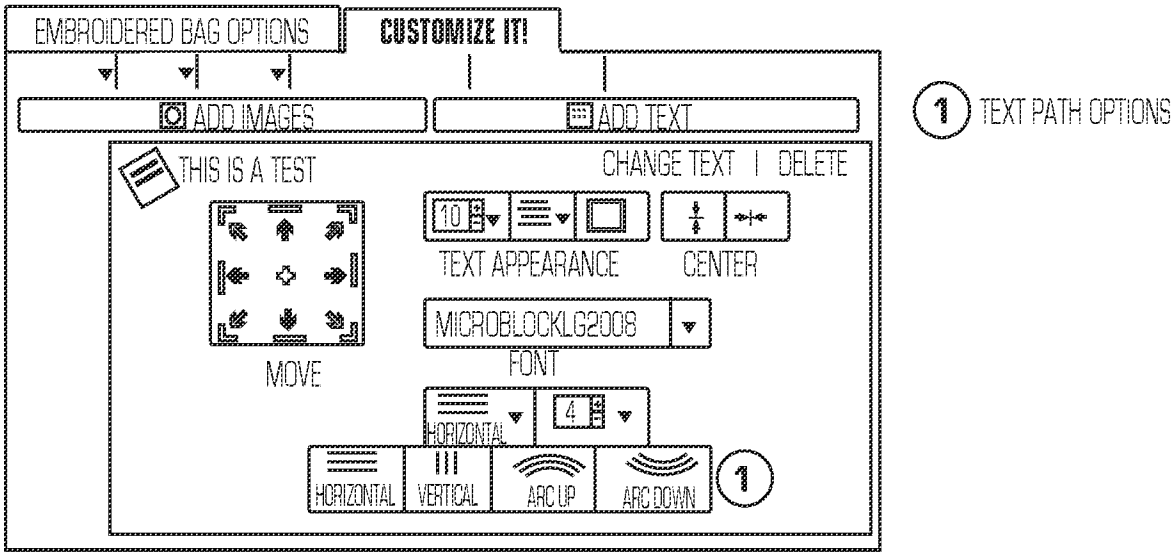

The embroiderable product design tool also has a user interface to allow the user to add embroidery text to an embroiderable product design as shown in FIGS. 4A and 4B. For embroidery text so added, user interface elements are provided to permit editing of properties of the text, such as its words and letters, color, font, size, path, and other properties of embroidery text supported by the embroidery system.

Figure 4C:
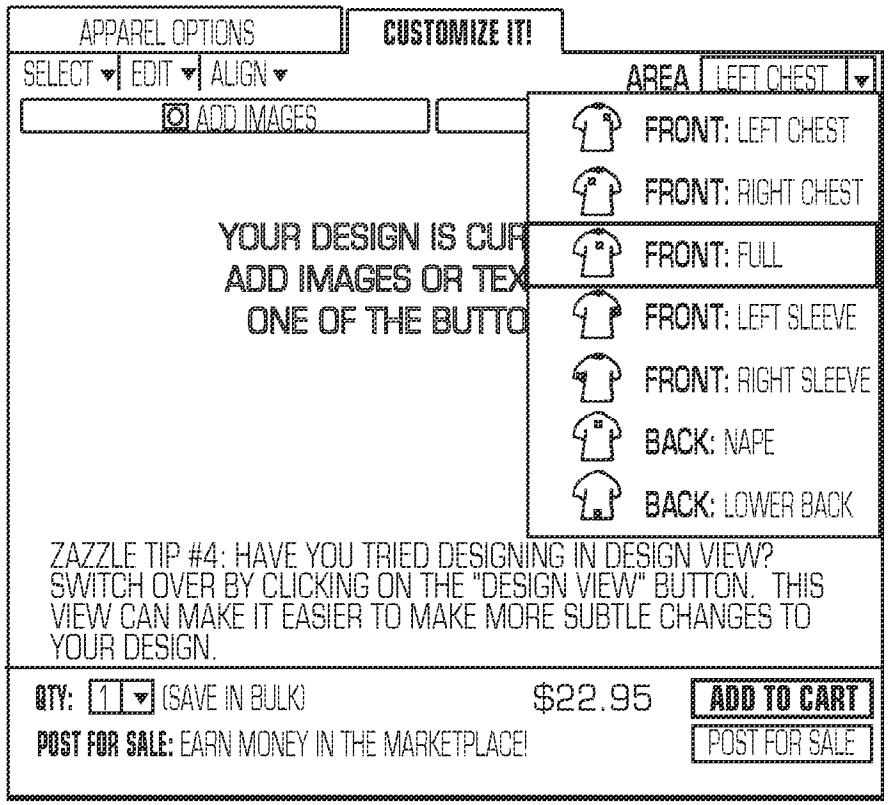
FIG. 4C illustrates a product design tool user interface for placing the design on particular location on a product.

The embroiderable product design tool also provides a variety of user interfaces to allow the user to edit placement, orientation, colors, and other properties—supported by the embroidery system—for embroidery design objects and embroidery text objects contained in an embroiderable product design. The editing functions may be provided that permit the user to perform operations upon a selection of one or more objects, such operations including basic editing actions—such as copy, cut, paste, delete, and others—along with more advanced layout functions—such as positioning, aligning, scaling, and others. FIG. 4C illustrates a product design tool user interface for placing the design on particular location on a product.

Figure 5A:
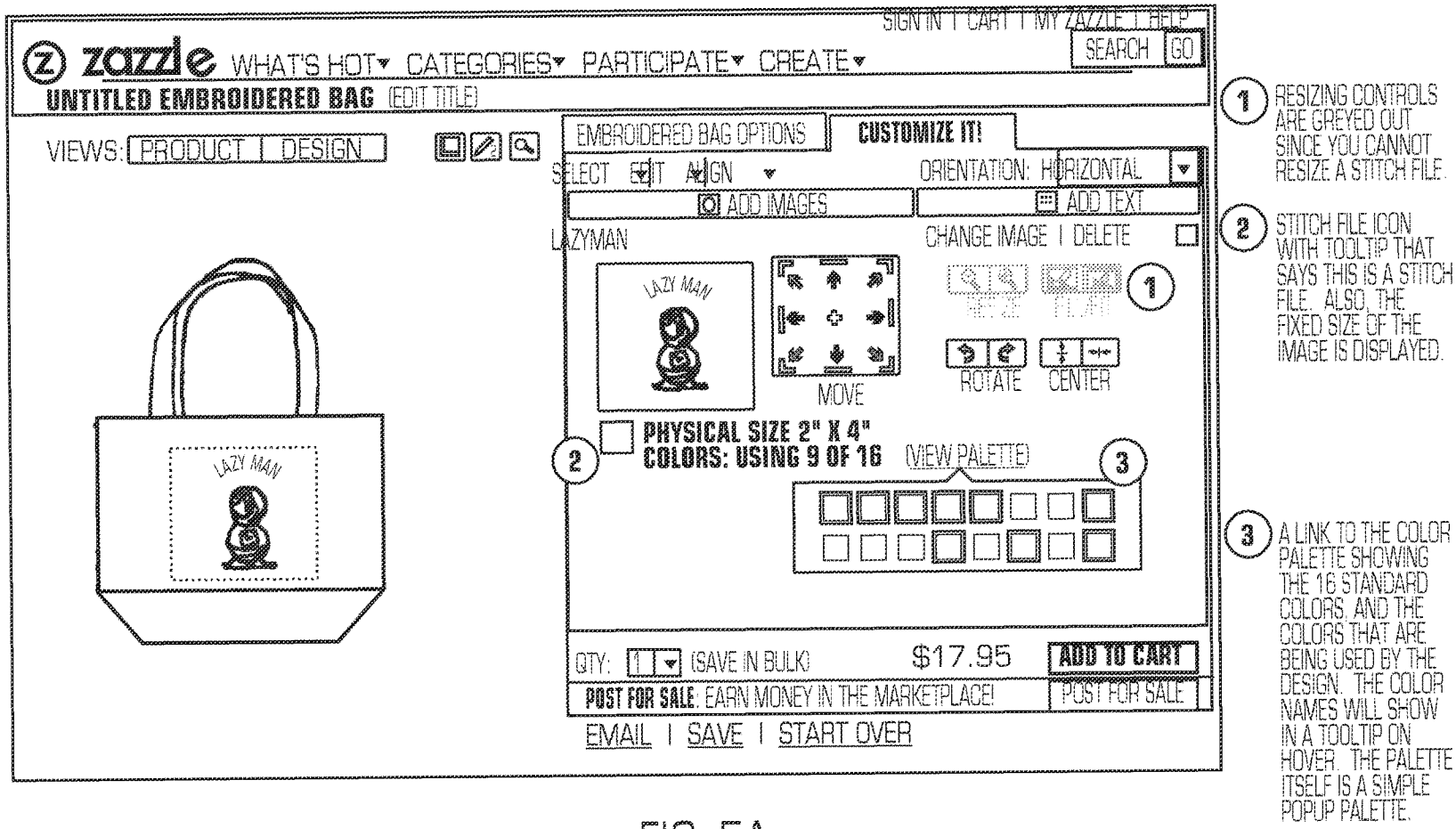
FIGS. 5A and 5B illustrate a product design tool including a color palette.
Figure 5B:
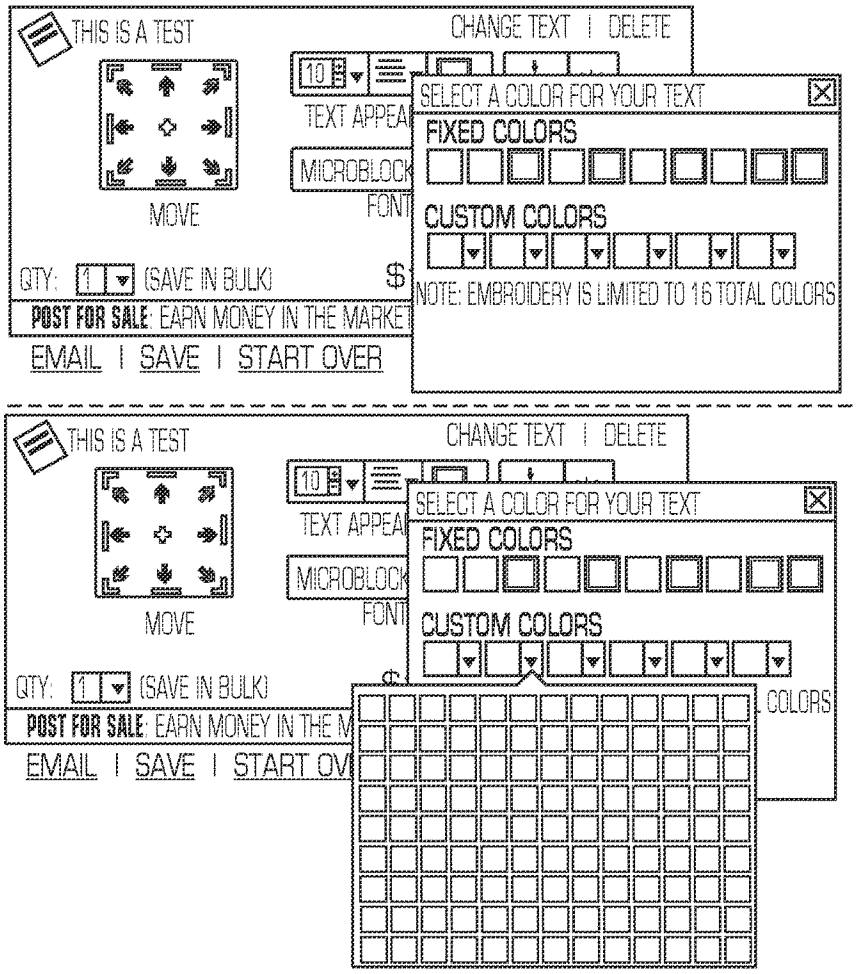

The embroiderable product design tool (shown for example in FIGS. 5A and 5B) also provides a user interface for the management of color choices for embroidery text, allowing the selection of colors already existing in the embroidery area color palette for newly added embroidery text, as well as the editing of colors already in use by embroidery text in an embroiderable area design. The user must respond to possible constraints on color choices imposed by the dynamic embroidery area color palette, in some cases prompting the user on how they might like to resolve conflicts as color availability changes.

In more detail, the embroidery area color palette (that may be implemented as a color palette module in software) is a collection of colors that may be used within the context of a single embroidery area design and the embroidery designs and embroidery text within an embroidery area design are limited to using colors that are contained within the embroidery area color palette. The embroidery area color palette may be divided into fixed colors that are derived from embroidery designs contained within an embroidery area design and that the user may not be able to change in the user interface of the embroiderable product design tool, along with custom colors that the user may be able to change and which may be applied to embroidery text within the embroidery area design. The embroidery area color palette may provide a mechanism by which the user can remap colors utilized by an embroidery design to colors that may be more appealing to the user or that may better match or complement the colors of other embroidery designs or embroidery text within the embroidery area design.

The embroiderable product design tool also includes an embroiderable product options configurator that permits the user to configure product options for the type of embroiderable product for which their embroiderable product design is intended, such options including style, color, and size, amongst others. The product options so chosen may impact the price that is reflected in the user interface as well as the visualization of the embroiderable product design. The user's configured product options will govern how an instance of the embroiderable product design is manufactured, and may also govern how a published embroiderable product design is represented in the embroiderable product design marketplace as described below in more detail.

The embroiderable product design tool also provides a tool for visualizing an embroiderable product design. At any stage during the editing of an embroiderable product design, the user may inspect the design as it is visualized upon a life-like representation of an embroiderable product (which view is termed a modelshot view), or the user may inspect a flat representation of one of the embroiderable area designs contained inside their embroiderable product design (which view is termed a design view). For modelshot views, selecting the desired view of an embroiderable product is accomplished through the modelshot view selector. For embroiderable area design views, selecting the desired embroiderable area design is accomplished through the embroiderable area design view selector.

At any stage during the editing of an embroiderable product design, the price for the purchase of a manufactured instance of the embroiderable product design may be reflected in the user interface, which price may consist of components such as the cost of manufacture, the cost of any translations that may be necessary by the embroidery design translation process, and the cost of product options configured for the embroiderable product—such as style and color, amongst others.

The embroiderable product design tool also may include an embroiderable product design validator employed within the embroiderable product design tool to prevent publishing or ordering of an embroiderable product design if such design violates certain constraints that are imposed by the embroidery system. Examples of such constraints include overlapping embroidery text or embroidery designs, and embroidery text or embroidery designs lying outside of the embroiderable area, amongst others. At any such time as an embroiderable product design tool enters a state where it violates constraints and thereby fails validation, elements of the user interface may warn and inform the user of the nature of the violation(s), and actions consequently impermissible may become disabled within the user interface. Furthermore, an interactive component of the embroiderable product design validator may preemptively limit actions within the user interface to prevent conditions in which the embroiderable product design will fail validation, an example of which is a constraint imposed upon the movement of objects within an embroiderable area to prevent the objects from falling outside of the embroiderable area.

The embroiderable product design tool also may include a management system that manages the exclusivity relationships that may exist between proximate embroiderable areas. This system is termed the embroiderable area exclusivity manager. The system is responsible for managing the appropriate enabling and disabling of user interface elements in response to limitations on available embroiderable areas, as determined by existing use of certain embroiderable areas that may be exclusive with other embroiderable areas in the superset of possible embroiderable areas. This system is also responsible for potentially removing embroiderable area designs from an embroiderable product design, if changes occur within the configurable options for the embroiderable product that would render the embroiderable areas for which those embroiderable area designs were intended no longer available in the superset of possible embroiderable areas.

An embroiderable product design created in the embroiderable product design tool can be saved to an embroiderable product design library, from where it can be later accessed for completion, publishing, or ordering. A system of permissions may allow the user to make embroiderable product designs within an embroiderable product design library visible to the public at large, visible only to a chosen group for whom permission has been granted to view those embroiderable product designs, or visible only to the embroiderable product design library owner.

An embroiderable product design created in the embroiderable product design tool can be published to the embroiderable product design marketplace, provided that the user has the appropriate publishing rights for content contained within the embroiderable product design. In such an event as publishing cannot be permitted, appropriate elements of the user interface may be disabled, or the user may be prompted upon attempting to publish.

An embroiderable product design created in the embroiderable product design tool can be ordered. Upon ordering, the customized and configured instance of the embroiderable product design is entered into a flow, which includes steps for procuring payment, and which ultimately results in it being manufactured by the embroidery machine and transported to the intended recipient.

Upon publishing or ordering of an embroiderable product design that contains rough embroidery previews, such rough embroidery previews become accepted rough embroidery previews and are entered into the embroidery design translation process for translation to embroidery designs. While payment may be collected prior to invoking the embroidery design translation process, a review step may be provided to allow the user to accept or decline embroidery designs resulting from the embroidery design translation process before completing publishing or ordering.

Manufacturing Component (136)

A design for an embroiderable product (referred to as an embroiderable product design) that uses the embroidery design so produced by the preceding steps (or any prior existing and approved embroidery designs), may then be manufactured (128). The manufactured embroiderable products are then shipped to the customer.

An embroidery production sheet is automatically printed for every new embroidery order that is successfully digitized. The embroidery production sheet is the signal to start the manufacturing process and contains information to guide the workers along in an efficient manner. An order can contain multiple embroidery products (i.e. one hat, one bag and three shirts). Furthermore, each product can contain multiple print areas where each area is a combination of embroidery designs and embroidery text as created by the user. An embroidery production sheet is printed for every product in the order and contains a section for each print area and each print area section also contains a barcode. The barcode is read by the embroidery command file generation software, which translates the compound design of that print area into a single command file for the embroidery machine.

Batches of production sheets, grouped by product type and order, get printed periodically. The period is defined by the shift manager. The production sheets are further grouped by print areas and thread colors and then given to workers and each worker is responsible for a set of embroidery machines optimized to print certain product types, areas, and thread color combinations. Each production sheet contains the following sections:

- An order section that contains order information such as shipping address and method along with a barcode that is read by shipping software to print a shipping label.
- A product section that contains product information such as item quantity and SKU (style, color and size). Additionally, to ensure that the correct SKU is quickly picked from inventory, there is an image of a model wearing the SKU. This section also contains a reference to other products in the same order to allow for quick collation of a customer's order before shipping.
- A print area section that contains information about each independent print area starting with the area name (i.e. left sleeve, right sleeve) and a unique barcode. Area names are always listed in a specific sequence to allow workers to sort production sheets quickly. This section also contains important stitch details about the print area:
  - Dimensions of the design.
  - Total number of stitches in the design.
  - Total number of threads required to stitch the design.
  - Visual mapping of the color of each thread to the actual thread number, ordered by the sew sequence. Again, this information allows the worker to quickly scan the production sheet and further group by thread color and sequence. Additionally, it allows the worker to quickly load the embroidery machine with the correct threads for a given job.

The embroidery command file generation software reads a barcode that uniquely identifies a print area, generates a command file to stitch that area, and spools that file to the embroidery machine. The software can be configured to send command files for specific print area and sew sequence combinations to specific embroidery machines that reduces the overall setup time for each stitch job.

Using an attached barcode scanner, the software reads a barcode that uniquely identifies a print area. Multiple areas can be scanned at once.

The software compiles multiple embroidery designs and embroidery text into a single command file representing the print area and the command file is sent to the embroidery machine as defined by the configuration.

A preview of the print area is shown to the worker to minimize operator error.

Upon completion of the job, an update is sent to the backend servers, allowing customers to get real-time status of their order.

Reflection Process/Component (138)

Then, a reflection process (129) collects metrics from the embroiderable product creation flow and used to refine the embroidery system. In more detail, the embroidery reflection component provides a feedback loop from manufacturing and design translation to the embroidery design unit. The embroidery reflection component collects manufacturing and translation information, packages it, and provides it in a usable form to other components of the embroidery system.

In one implementation, the list of the types of information provided to each component may include:

1. Rough Embroidery Preview Component
   - a. Thread Color Constraints
     - i. Optimal Thread Library Colors based on use metrics
     - ii. Optimal Color use and counts for Designs based on use metrics
     - iii. Thread Color Characteristics
       - 1. Integrated Thread Color
     - iv. Color region resolution based on test
   - b. Manufacturing Process Resolution
     - i. Measurement of Embroidery Design resolution based on test assets
   - c. Stitch Density Metrics based on use
   - d. Stitch Coverage based on use
2. Rough Embroidery Preview Quote Component
   - a. Embroidery Design Translation Process Costs
     - i. Related to image area metrics
     - ii. Related to image complexity metrics
   - b. Embroidery Manufacturing Costs
     - i. Thread Change costs
     - ii. Operator Costs
     - iii. Cost of Goods
3. Embroiderable Product Design Tool Component
   - a. Modelshots
     - i. Product Design Area Placement
       - 1. Placement of reference designs
       - 2. Production of reference product
     - ii. Design Area Set Mappings
       - 1. Description of Self-Exclusive design Area Sets
     - iii. Color Mapping curves
       - 1. Collected from reference SKU swatches
4. Embroidery Design Translation Process Component
   - a. Collect Source Image and Rough Embroidery Preview metrics
   - b. Collect Embroidery Design Translation costs 5. Embroidery Simulation Component
   a. Thread Color
      i. Ambient Lighting Function Curves based on test of thread
      ii. Diffuse Lighting Function Curves based on test of thread
      iii. Specular Lighting Function Curves based on test of thread
      iv. Thread Fibril Twist Frequency Distribution determined by test
   b. Embroidery Machine Properties
      i. Color Limits
      ii. Stitch Placement resolution and repeatability
      iii. Distribution of Stitch placement error
6. Embroidery Manufacturing Component
   a. Specify Reference Product for Manufacture
   b. Collect Manufacturing costs
      i. Thread Change costs
      ii. Operator Costs
      iii. Cost of Goods The embroidery system (that implements the method shown in FIG. 1B) may automate those components of the system which may create extra work for the customer or may cause the customer to wait for long periods of time unnecessarily and may include: the interactive presentation of a rough embroidery preview; binding quote for the translation of a source image to an embroidery design, informed by the rough embroidery preview (the rough embroidery preview quote); creation and management of an embroidery design proxy for editing. (the rough embroidery preview); interactive editing, placement, and view of rough embroidery previews, embroidery designs, and embroidery text on an embroiderable product (embroiderable product design tool and modelshots); contract management of skilled artisans for creating embroidery designs (the embroidery design translation process); customer review of translated embroidery designs using a visual simulation (the embroidery simulation); production of custom embroiderable product designs (manufacturing); and collecting data used to refine the system.

Embroidery Product Design Marketplace and Embroidery Design Marketplace

Figure 6B:
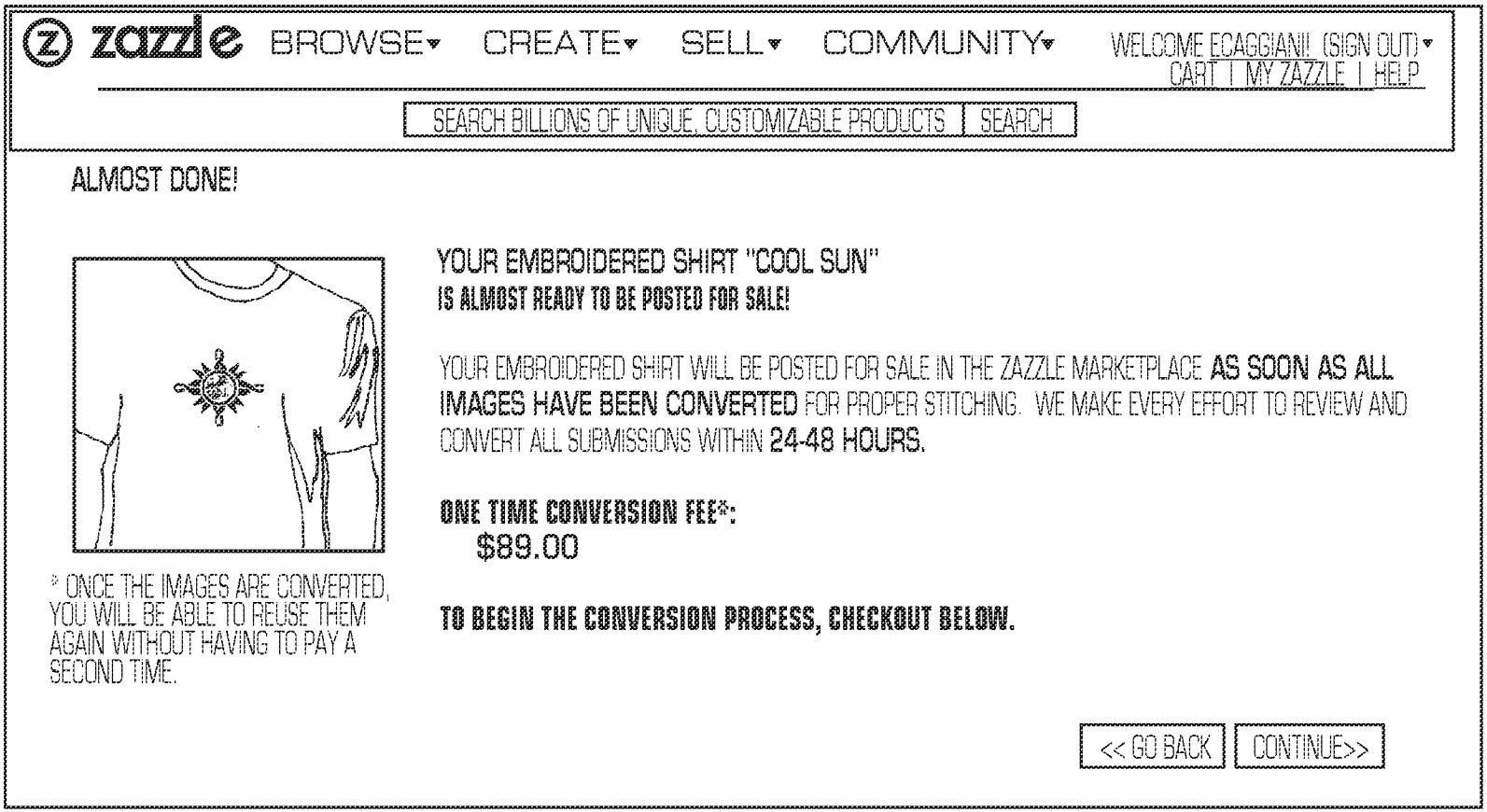
Figure 6C:
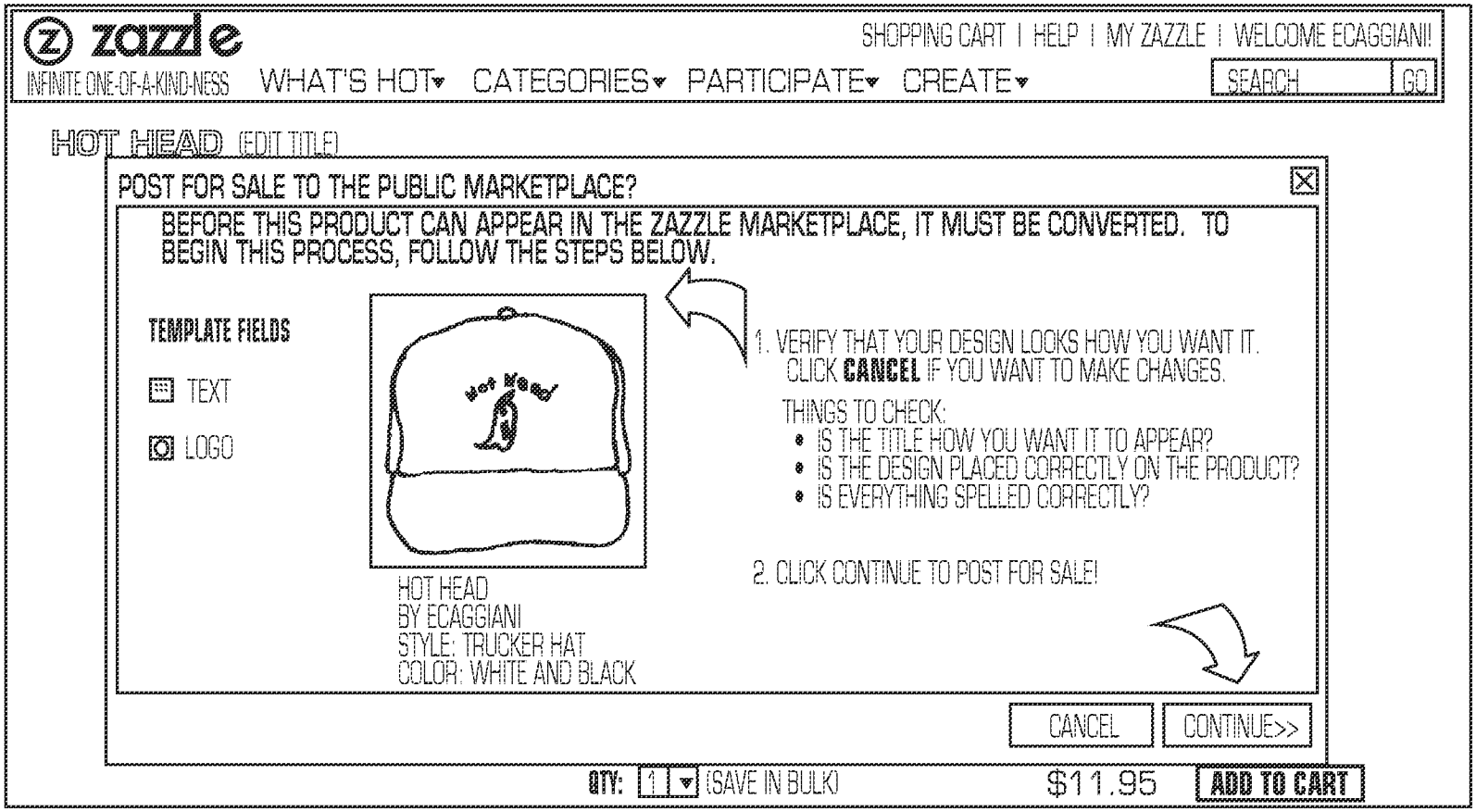

The embroidery system may also include an embroidery design marketplace that is a collection of embroidery designs that is made available to general users within the embroiderable product design tool during the process of creating embroiderable product designs. The marketplace may be one or more units that permit the display of the embroidery designs (a display unit that displays the embroidery designs in web pages in a known manner), that allow users to purchase an embroidery design (the e-commerce engine) and allows the owner of the purchased embroidery design to receive a royalty (also part of the e-commerce engine). In one implementation, the marketplace may be one or more server computers executing software code to implement the marketplace. FIGS. 6A-6C illustrate an example of a user interfaces for posting a design or product in the embroidery marketplace that is part of the embroidery system. The contents of the embroidery design marketplace may be comprised of embroidery designs from multiple embroidery design libraries and listed at the discretion of embroidery design library owners, as well as embroidery designs pre-populated into the embroidery design marketplace by the concern hosting the embroidery system. The utilization, by a general user, of an embroidery design listed in the embroidery design marketplace by an embroidery design library owner may result in a usage royalty or other remuneration accruing to that embroidery design library owner. The seller of a embroidery design may receive a royalty such as a percentage of the purchase price or a flat fee.

The embroidery system may also include an embroidery product design marketplace that is a collection of embroidery product designs that is made available to general users for purchase and optional customizing within the embroiderable product design tool. The embroidery product design marketplace is distinct from the embroidery design marketplace in that the embroidery product design marketplace consists of embroidery product designs that are ready for manufacture by the embroidery machine, whereas the embroidery design marketplace consists of embroidery designs that can be used in the creation of embroidery product designs within the embroiderable product design tool. The seller of a embroidery product design may receive a royalty such as a percentage of the purchase price or a flat fee.

The contents of the embroidery product design marketplace may be comprised of embroidery product designs from multiple embroidery product design libraries and listed at the discretion of embroidery product design library owners, as well as embroidery product designs pre-populated into the embroidery product design marketplace by the concern hosting the embroidery system. The purchase, by a general user, of an embroidery product design listed in the embroidery product design marketplace by an embroidery product design library owner may result in a royalty or other remuneration accruing to that embroidery product design library owner.

In the embroidery product design marketplace, a seller can publish products that are templates that contain the embroidery design of the seller and one or more placeholders for a buyer to insert their own custom text or images using the embroidery product design marketplace. The buyer can add his/her custom text/images and then buy the product with the seller again receiving a royalty such as a percentage of the purchase price or a flat fee.

While the foregoing has been with reference to a particular embodiment of the invention, it will be appreciated by those skilled in the art that changes in this embodiment may be made without departing from the principles and spirit of the invention, the scope of which is defined by the appended claims.

The invention claimed is:

1. An embroidery system, comprising:

a computer embroidery design unit that has a design unit for accepting a source image over a computer network and creating a custom design for embroidery;

a preview quote component which analyzes the source image and calculates a stich count estimate based on the area of the source image multiplied by a factor and then adds a minimum stich count estimate value;

a preview generator which reduces colors in the source image, the preview generator also detects and removes background in the source image;

an embroidery design library that stores one or more embroidery designs;

an embroidery design translation unit that converts the source image after color reduction and background removal into a custom design for embroidery and generates a stitch file;

an embroidery product design tool for designing a product having the custom design for embroidery;

an embroidery unit that generates a rendering of the product with the embroidery custom design, wherein the rendering of the product with the embroidery custom design embodies an interaction of light with the stitches of the design for embroidery; and wherein the embroidery design library also stores a rough embroidery preview for each embroidery design, and wherein the rough embroidery preview is used to design a product having the design for embroidery while the stitch file is being generated.

2. The system of claim 1 further comprising a marketplace unit having a display unit that displays the designs for embroidery and an ecommerce engine that permits a user to select a displayed design for embroidery and purchase the selected design for embroidery.

3. The system of claim 1, wherein the embroidery design translation unit further comprises instructions that reduce the colors to a maximum number of colors and that remove any background of the design for embroidery to generate the stitch file.

4. The system of claim 1, wherein the embroidery design translation unit further comprises instructions that estimate the stitch count of the stitch file based on an area covered by a foreground of the design for embroidery.

5. The system of claim 1, wherein the embroidery design translation unit further comprises instructions that determine a price for the stitch file based on the stitch count.

6. The system of claim 1, wherein the rendered design for embroidery has one of a variation in a placement of the stitches of the design for embroidery and a thread response.

7. An embroidery system, comprising:

a computer embroidery design unit that has a design unit for accepting a source image over a computer network and creating a custom design for embroidery;

a preview quote component which analyzes the source image and calculates a stich count estimate based on the area of the source image which is multiplied by a factor and then added to a minimum stich count estimate value;

a preview generator which reduces colors in the source image, the preview generator also detects and removes background in the source image;

an embroidery design translation unit that converts the source image after color reduction and background removal into a custom design for embroidery and generates a stitch file;

an embroidery design library that stores one or more stitch files associated with the custom designs for embroidery; and an embroidery unit that generates a rendering of the product with the embroidery custom design, wherein the rendering of the product with the embroidery custom design embodies an interaction of light with the stitches of the design for embroidery; and wherein the embroidery design library also stores a rough embroidery preview for each embroidery design, and wherein the rough embroidery preview is used to design a product having the design for embroidery while the stitch file is being generated.

8. The system of claim 7, wherein the embroidery design library stores designs for embroidery for which the stitch file has not been generated.

9. The system of claim 7, wherein the embroidery design library stores images and stitch files for the images.

10. The system of claim 7, wherein the embroidery design library stores an image and a plurality of stitch files associated with the image wherein each stitch file has a predetermined size.

11. An embroidery system, comprising:

a computer embroidery design unit that has a design unit for accepting a source image over a computer network and creating a custom design for embroidery;

a preview quote component which analyzes the source image and calculates a stich count estimate based on the area of the source image which is multiplied by a factor and then added to a minimum stich count estimate value;

a preview generator which reduces colors in the source image, the preview generator also detects and removes background in the source image;

a plurality of embroidery design libraries, each embroidery design library having one or more embroidery designs of a particular embroidery design owner; and a marketplace unit having a display unit that displays the embroidery designs for the embroidery design owners and an ecommerce engine that permits a user to select a displayed embroidery design and purchase the selected embroidery design, wherein the embroidery design owner of the selected embroidery design receives a royalty for the selected embroidery design.

12. The system of claim 11, wherein the royalty further comprises a percentage of the purchase price or a predetermined amount of money.

13. The system of claim 11 further comprising a plurality of embroidery product design libraries, each embroidery product design library having one or more embroidery product designs of a particular embroidery product design owner, and wherein the display unit displays the embroidery product designs, the ecommerce engine permit a user to select and purchase a displayed embroidery product design and wherein the owner of the embroidery product design receive a royalty for the selected embroidery product design.

14. An embroidery system, comprising:

a computer embroidery design unit that has a design unit for accepting a source image over a computer network and creating a custom design for embroidery;

a preview quote component which analyzes the source image and calculates a stich count estimate based on the area of the source image which is multiplied by a factor and then added to a minimum stich count estimate value;

a preview generator which reduces colors in the source image, the preview generator also detects and removes background in the source image;

a plurality of embroidery product design libraries, each embroidery product design library having one or more embroidery product designs of a particular embroidery product design owner; and a marketplace unit having a display unit that displays the embroidery product designs for the embroidery product design owners and an ecommerce engine that permits a user to select a displayed embroidery product design and purchase the selected embroidery product design, wherein the embroidery product design owner of the selected embroidery product design receives a royalty for the selected embroidery product design.

15. The system of claim 14, wherein the royalty further comprises a percentage of the purchase price or a predetermined amount of money.

16. The system of claim 14, wherein the embroidery product design further comprises an embroidery design of the embroidery product design owner and a template for a design of a buyer wherein the purchased product has the embroidery design of the embroidery product design owner and the design of the buyer.

17. The system of claim 14, wherein the embroidery product design further comprises an embroidery design of the embroidery product design owner that is modified by a buyer wherein the purchased product has the modified embroidery design of the embroidery product design owner and wherein the embroidery product design owner of the selected embroidery product design receives a royalty for the selected embroidery product design.

* * * * *